US010920416B2

(12) United States Patent
Klein et al.

(10) Patent No.: US 10,920,416 B2
(45) Date of Patent: Feb. 16, 2021

(54) DRYWALL AND SEALING DEVICE FOR SEALING A CONNECTION JOINT OF A DRYWALL

(71) Applicant: HILTI AKTIENGESELLSCHAFT, Schaan (LI)

(72) Inventors: Manfred Klein, Kaufering (DE); Christian Foerg, Dillishausen (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 304 days.

(21) Appl. No.: 16/066,077

(22) PCT Filed: Jan. 11, 2017

(86) PCT No.: PCT/EP2017/050435
§ 371 (c)(1),
(2) Date: Jun. 26, 2018

(87) PCT Pub. No.: WO2017/129398
PCT Pub. Date: Aug. 3, 2017

(65) Prior Publication Data

US 2020/0263418 A1 Aug. 20, 2020

(30) Foreign Application Priority Data

Jan. 25, 2016 (EP) ..... 16152551

(51) Int. Cl.
*E04B 1/94* (2006.01)
*E04B 2/72* (2006.01)

(52) U.S. Cl.
CPC ..... *E04B 1/947* (2013.01); *E04B 1/948* (2013.01); *E04B 2/721* (2013.01)

(58) Field of Classification Search
CPC ..... E04B 1/947; E04B 1/948; E04B 2/721; E04B 2/825; E04B 2/7457; E04B 2/7411
See application file for complete search history.

(56) References Cited

U.S. PATENT DOCUMENTS 3,460,302 A * 8/1969 Cooper ..... E04B 2/825 52/242
5,755,066 A * 5/1998 Becker ..... E04B 2/7411 52/241

(Continued)

OTHER PUBLICATIONS

International Search Report mailed in PCT/EP2017/050435 dated Feb. 7, 2017, with English language translation.

(Continued)

*Primary Examiner* — Adriana Figueroa
(74) *Attorney, Agent, or Firm* — Grüneberg and Myers PLLC

(57) ABSTRACT

A drywall can be used as an attachment to a connecting building element. The drywall includes a connecting profile, at least one drywall panel, and at least one flat sealing device. The flat sealing device extends in an extent direction and has, transverse thereto, a retaining portion for positioning between a base portion and the connecting building element, a sealing portion, and a positioning portion for positioning on an outer side of the drywall panel. The flat sealing device is so disposed that a cavity is formed between an edge of the drywall panel, the connecting building element, the limb portion of the connecting profile, and the sealing portion.

11 Claims, 1 Drawing Sheet

(56) References Cited

U.S. PATENT DOCUMENTS

| | | | | |
|---|---|---|---|---|
| 7,240,905 | B1 | 7/2007 | Stahl, Sr. | |
| 7,681,365 | B2 * | 3/2010 | Klein | E04B 2/7411 52/1 |
| 8,061,099 | B2 * | 11/2011 | Andrews | E04B 2/767 52/483.1 |
| 8,181,404 | B2 * | 5/2012 | Klein | E04B 2/7411 52/232 |
| 8,590,231 | B2 * | 11/2013 | Pilz | E04B 2/7411 52/232 |
| 8,595,999 | B1 * | 12/2013 | Pilz | E04B 1/943 52/232 |
| 8,640,415 | B2 * | 2/2014 | Pilz | E04B 2/7411 52/232 |
| 8,793,947 | B2 * | 8/2014 | Pilz | E04B 2/7457 52/232 |
| 8,826,599 | B2 | 9/2014 | Stahl, Jr. | |
| 9,045,899 | B2 * | 6/2015 | Pilz | E04B 2/7411 |
| 9,127,454 | B2 * | 9/2015 | Pilz | E04B 1/948 |
| 9,512,614 | B2 * | 12/2016 | Klein | E04B 2/7411 |
| 9,719,253 | B2 * | 8/2017 | Stahl, Jr. | E04B 2/7409 |
| 9,995,040 | B2 * | 6/2018 | Stahl, Jr. | E04B 2/7409 |
| 2006/0137293 | A1 | 6/2006 | Klein | |
| 2010/0293888 | A1 | 11/2010 | Andrews | |

OTHER PUBLICATIONS

Written Opinion of the International Searching Authority mailed in PCT/EP2017/050435 dated Feb. 7, 2017.

* cited by examiner

DRYWALL AND SEALING DEVICE FOR SEALING A CONNECTION JOINT OF A DRYWALL

This application is a National Stage entry under § 371 of International Application No. PCT/EP2017/050435, filed on Jan. 11, 2017, and claims priority to European Patent Application No. 16152551.4, filed on Jan. 25, 2016.

FIELD OF THE INVENTION

The invention relates to drywalls for introduction into rooms and especially to measures for sealing a connecting joint between a drywall and a connecting building element, such as, for example, a room ceiling, a floor or a solid wall.

BACKGROUND OF THE INVENTION

Connecting profiles for drywalls are used for joining the drywall to a connecting building part, such as, for example, a room ceiling, a floor and/or a solid wall. Such a connecting profile usually has a U-shaped cross section, the base face of which is attached parallel to the fastening face of the connecting building part, so that its limb faces protrude from the connecting face in question. Drywall panels, such as gypsum boards, for example, may be fastened to the limb faces of the connecting profile.

In general, the connecting profile is attached to the connecting building part, wherein the drywall panels are attached with a defined spacing to the connecting building part on the limbs of the connecting profile. Usually the sealing of the drywall takes place in the region of a joint between the drywall panel and the connecting building part; for example, either a suitable sealing compound is introduced or the joint is filled with mineral wool and equipped at the surface with a sealing layer. In both cases, the material present in the joint between drywall and connecting building part hinders the movement of the drywall panel relatively strongly. To achieve adequate absorption of movement, therefore, it is necessary to choose a relatively large joint width, which can be sealed only with increased expense.

Furthermore, the sealing of the joint with a sealing compound represents an additional working step, which can be carried out only after mounting of the drywall panels and, moreover, requires access to the finished drywall from both sides. Furthermore, this procedure is error-prone, since the user himself or herself must dose the quantity of sealing material manually in order to seal the joint adequately.

Furthermore, because the expandability and compressibility of the sealing compound are limited to approximately ±25% at most, the width of the joint must be selected to correspond to the material and properties of the sealing compound being used. In particular, during expansion of the joint, it must be ensured that the sealing compound adheres sufficiently strongly to the underlying surface and that it is able to absorb the tensile forces that develop. Otherwise a risk of cracking or of detachment of the sealing compound from the connecting building part exists. In the case of narrowing of the joint width, the sealing compound, because of its material properties, can be compressed to only a limited extent, and the danger exists that it will be forced out if the joint is incorrectly dimensioned.

Some further approaches exist for sealing of joints, especially joint cords or joint sprays, which have similar disadvantages.

Furthermore, U-shaped connecting profiles are known in which fire protection is realized in the form of an intumescent sealing strip on outer faces of the limb portions. Due to the thickness of the sealing strip, drywall panels fastened thereto rest on the sealing strip and thus seal the rim region of the drywall panels. Since the drywall panels are attached to the limb portions of the connecting profile, the thickness of the sealing strip cannot be selected to be arbitrarily large, since otherwise undesired kinking/breaking of the drywall panels is possible. Because of the limited thickness of the sealing strip, its thermal insulating effect is limited and in the fire situation a temperature overshoot develops on the cold side of the sealing strip. Furthermore, the manufacture of intumescent materials is relatively expensive.

In addition, intumescent materials are relatively stiff, and so irregularities of the drywall panels or of the connecting building element can be evened out only poorly and leaks may develop.

For example, a connecting profile for a drywall, in which sealing of the joints between drywall panel and connecting building element is achieved by an intumescent strip, is known from U.S. Pat. No. 7,681,365 B2.

U.S. Pat. No. 7,240,905 A teaches a joint-sealing tape that is placed on and fastened to the rim of a drywall panel and covers the joint between the drywall panel and the connecting building element. Sealing is achieved by the fact that the joint-sealing tape is attached in such a way that it bears on the connecting building element. In the region of the joint, the joint-sealing tape is deformed out of the plane, so that it is able to absorb movements of the drywall panel. The joint-sealing tape is formed from fireproof and deformable material.

In order to achieve adequate fire resistance and imperviousness to smoke, however, the joint-sealing tape must be coated after it has been mounted.

U.S. Pat. No. 8,826,599 B2 discloses an intumescent sealing tape that extends over the entire outer side of a U-shaped connecting profile. The drywall panels are then mounted on the connecting profile in such a way that the intumescent sealing tape is disposed between a limb portion of the connecting profile and the drywall panel fastened thereon. A disadvantage of this is the inadequate thermal insulation on the cold side in a fire situation, due to the small thickness of the sealing tape.

It is the object of the present invention to provide a sealing device for sealing a joint between a drywall panel and a connecting building element, such as a room ceiling, a floor and/or a solid wall, for example, with which improved sealing and improved fire protection can be ensured.

SUMMARY OF THE INVENTION

This object is solved by the sealing device for a drywall according to claim 1 as well as by a drywall according to the secondary claim.

Further configurations are specified in the dependent claims.

According to a first aspect, a drywall for attachment to a connecting building element, especially a room ceiling, a floor or a solid wall, is provided, comprising:

- a connecting profile, which has, extending in extent direction, a profile piece with a U-shaped cross section, wherein the cross section of the profile part has a base portion with oppositely disposed edges transverse to the extent direction, wherein limb portions protrude from the oppositely disposed edges,
- at least one drywall panel, which is fastened to an outer face of a limb portion of the U-shaped cross section of the profile piece, such that it protrudes transversely from the connecting building element; and at least one flat sealing device, which extends in extent direction and which has, transverse thereto, a retaining portion for positioning between the base portion and the connecting building element, a sealing portion and a positioning portion for positioning on an outer side of the drywall panel, wherein the sealing device is so disposed that a cavity is formed between an edge of the drywall panel, the connecting building element, the limb portion of the connecting profile and the sealing portion.

One idea for the foregoing drywall consists in disposing a tape-like sealing device in such a way that a cavity is formed between a limb portion of a connecting profile, an end of a drywall panel facing the connecting building element, the connecting building element and the sealing portion of the sealing device. Due to the formation of the cavity, a thermally insulating air cushion is obtained, with which good insulation is achieved and which in the fire situation is able to minimize the temperature rise on the cold side. In particular, it is possible thereby to prevent a temperature overshoot and associated spontaneous ignition in the fire situation.

Due to the provision of the retaining portion and of the positioning portion, the sealing device can be positioned reliably on the connecting profile, so that a sealed cavity is formed.

In addition, movements of the drywall panels relative to the connecting building element can be absorbed without leading to opening of the cavity. Moreover, the sealing device can be mounted in simple manner and thereby has low susceptibility to failure.

According to a further aspect, a sealing device for a drywall is provided, wherein the sealing device is elongated in an extent direction and, transverse thereto, has a retaining portion, a sealing portion and a positioning portion, wherein the sealing portion is equipped at least on one side with an intumescent material or contains an ablatively acting fire-protection additive, in which case both individual compounds and a mixture of several compounds may be used as additives. The intumescent material may be an intumescent foam, an intumescent coating or an intumescent strip.

Thus the sealing device may be provided in the region of the sealing portion with an intumescent material, so that the cavity becomes completely or partly filled by the intumescent material being formed under the effect of heat. Thereby the thermal insulation of the cavity can be improved by expansion of the intumescent material in the fire situation.

It may be provided that the sealing device is equipped in the region of the sealing portion with kinking points, in order to form several segments of the sealing portion that can be tilted toward one another, at least one of which is oriented at an inclination or transverse to the extent of the limb portion of the profile piece. This permits absorption of relative movements between the drywall panel and the connecting building element.

In particular, the sealing device may be equipped in the region of the sealing portion with three kinking points, so that two segments of the sealing portion that can be tilted toward one another are formed with V-shape or V-like shape. This permits absorption of relative movements between the drywall panel and the connecting building element with particularly little effort.

Furthermore, the V-shape or V-like shape of the segments of the sealing portion point in the direction of the limb portion or in a direction opposite thereto.

According to one embodiment, the positioning portion of the sealing device may be equipped with a sealing element, in order to seal a gap relative to the positioning portion and the drywall panel.

Furthermore, a projecting stop element, especially beads protruding in the direction of the cavity, may be provided between the retaining portion and the sealing portion. Thereby the mounting of the sealing device on the connecting profile can be considerably simplified.

Furthermore, the sealing device may be equipped in the region of the sealing portion with kinking points, in order to form several segments of the sealing portion that can be tilted toward one another.

According to a further aspect, a use of a flat sealing device is provided for a drywall on a connecting building element, especially a room ceiling, a floor or a solid wall. The drywall has a connecting profile and a drywall panel, wherein the connecting profile has, extending in extent direction, a profile piece with a U-shaped cross section. The cross section of the profile piece has a base portion with oppositely disposed edges transverse to the extent direction, wherein limb portions protrude from the oppositely disposed edges and wherein the drywall panel is fastened on an outer face of a limb portion of the U-shaped cross section of the profile piece, so that it protrudes transversely from the connecting building element. The sealing device extends in extent direction and has, transverse thereto, a retaining portion for positioning between the base portion and the connecting building element, a sealing portion and a positioning portion for positioning on an outer side of the drywall panel. The sealing device may be disposed in such a way that a cavity is formed between an edge of the drywall panel, the connecting building element, the limb portion of the connecting profile and the sealing portion.

BRIEF DESCRIPTION OF THE FIGURES

Embodiments will be explained in more detail hereinafter on the basis of the attached drawings, wherein.

DETAILED DESCRIPTION OF THE FIGURES

Figure 1:
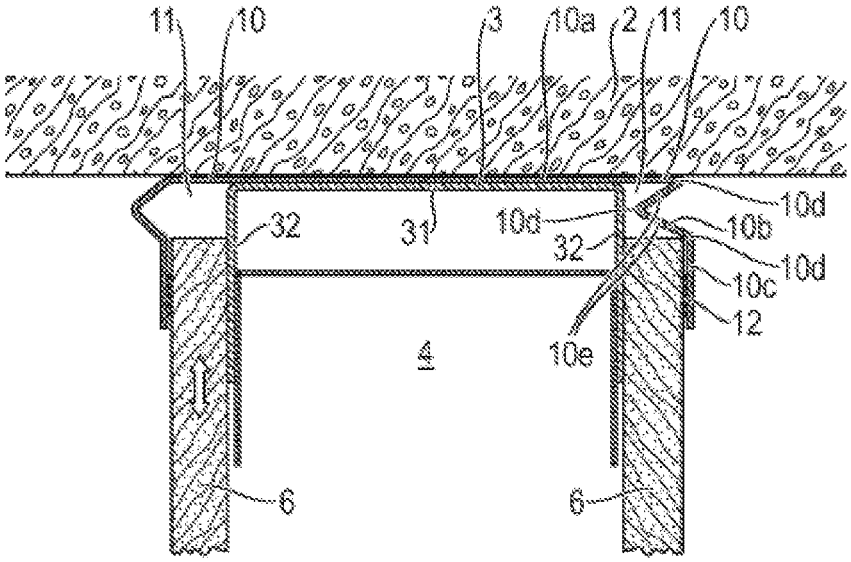
FIG. 1 shows a cross-sectional diagram through a rim portion of a drywall with a sealing device according to a first embodiment.

FIG. 1 shows a cross-sectional diagram of a connecting region A of a drywall 1 on a connecting building element 2. Connecting building element 2 may be a portion of a floor, of a room or inter-story ceiling or of a solid wall of a building.

In connecting region A, drywall 1 is equipped with a connecting profile that has a profile piece 3. Profile piece 3 has a substantially U-shaped cross section and extends in the manner of a rail along the extent direction (in the drawing plane) of drywall 1 in connecting region A. Profile piece 3 is usually formed from a metallic material (sheet metal); in particular, it is manufactured from a metal sheet by one or more stamping processes and a subsequent bending process. Thereby U-shaped profile piece 3 has a base portion 31 and two limb portions 32 protruding from base portion 31. Profile piece 3 is fastened in appropriate manner with one outer face of base portion 31 to connecting building element 2.

A core element 4, which corresponds to a carrier element of the drywall and may be formed with an absorbing or insulating material, may be disposed between limb portions 32, spaced apart from the inner face of base portion 31. Core element 4 may be fastened by means of screws to one or both limb portions 32 of profile piece 3, so that a rim region of core element 4 extends between limb portions 32. The screw connection of core element 4 is achieved by fixation with screws through corresponding fastening openings 33 in limb portions 32 of profile piece 3.

Usually such profile pieces 3 are equipped with regular slits, which are disposed in distributed manner along the extent direction of profile piece 3.

Drywall panels 6, which are attached in appropriate manner by screws, are connected to limb portions 32 of profile piece 3. Such drywall panels 6 are known and are usually formed from a gypsum-cardboard composite material. Drywall panels 6 are disposed spaced apart from connecting building element 2, so that a joint 7 is formed over the entire extent of drywall 6 along connecting building element 2.

Because of joint 7, smoke gases and flames may come into contact with profile piece 3 in the fire situation and thereby cause heating of profile piece 3. Thereby, due to the metal material of profile piece 3, a temperature rise may occur on the side of profile piece 3 facing away from the fire. In particular, the temperature on the side facing away from the fire may rise so much due to heat conduction through the material of profile piece 3 or to penetrating smoke gases that a critical temperature overshoot may develop.

In the embodiment shown in FIG. 1, a sealing device 10 is further provided that extends substantially along the extent direction of profile piece 3. The tape-like sealing device 10 functions to form a cavity in the region of joint 7 between the edge of drywall panel 6 and connecting building element 2 and limb portion 32 of the connecting profile.

Sealing device 10 is preferably formed from a flat material with a thickness of between 1 and 3 mm. In particular, sealing device 10 may be formed from a fire-retardant, fireproof and heat-resistant material. Suitable materials for sealing device 10 include materials such as foil, paper, nonwoven, fiber composite material, plastic, metallic materials or the like, especially a foil.

Relative to its cross section, sealing device 10 has a retaining portion 10*a*, which in the mounted state extends at least partly between connecting building element 2 and base portion 31 of the connecting profile. A sealing portion 10*b* is connected to retaining portion 10*a* on one side or both sides of retaining portion 10*a* and in its further continuation merges into a positioning portion 10*c*. Positioning portion 10*c* functions to position sealing device 10 on an outer side of the rim region of drywall panel 6 and then to attach or to fasten it on drywall panel 6, especially by stapling but also by adhesive bonding or by the use of interlocking and force-fitting means. Sealing portion 10*b* has a cross-sectional geometry for forming a cavity 11 with limb portion 32 of profile piece 3 and an end face of drywall panel 6. Cavity 11 offers thermal insulation and prevents hot smoke gases or flames from acting directly on profile piece 3 in the fire situation.

In order to achieve imperviousness to smoke for the fire situation, positioning portion 10*c* may further be equipped with a sealing element 12, in order in the mounted state to prevent smoke gases from being able to penetrate through an intermediate space between drywall panel 6 and sealing device 10 into cavity 11.

Sealing element 12 is disposed on an inner face of positioning portion 10*c*. The inner face of positioning portion 10*c* corresponds to the face that in the mounted state points in the direction of drywall panel 6. The material of sealing element 12 may contain a PU foam, mineral wool or the like, so that reliable sealing of a possible gap between drywall panel 6 and positioning portion 10*c* of sealing device 10 is achieved.

In the embodiment of FIG. 1, retaining portion 10*a* is formed with a width that is greater than the width of base portion 31 of profile piece 3, and sealing portion 10*b* has several kinking points, in the shown exemplary embodiment three kinking points 10*d*, in order to form segments 10*e* and to be able to absorb a movement of drywall panel 6 relative to connecting element 2 by movements of segments 10*e* of sealing portion 10*b* at kinking points 10*d*. For this purpose, at least two segments 10*e* linked to one another are provided, which are oriented at an inclination or transverse to the direction of the extent of limb portions 32.

During a movement of drywall panel 6 relative to connecting building element 2, segments 10*e* of sealing portion 10*b* formed between kinking points 10*d* move relative to one another. By provision of acute angles between segments 10*e* in the mounted state, it is possible to ensure absorption of relative movements between drywall panel 6 and connecting building element 2 with particularly little effort.

At least two of the segments 10*e* are now able to form, in cross section, a V-shape or a V-like shape, which relative to the formed cavity 11 extends inwardly (right side in FIG. 1) or outwardly (left side in FIG. 1).

Figure 2:
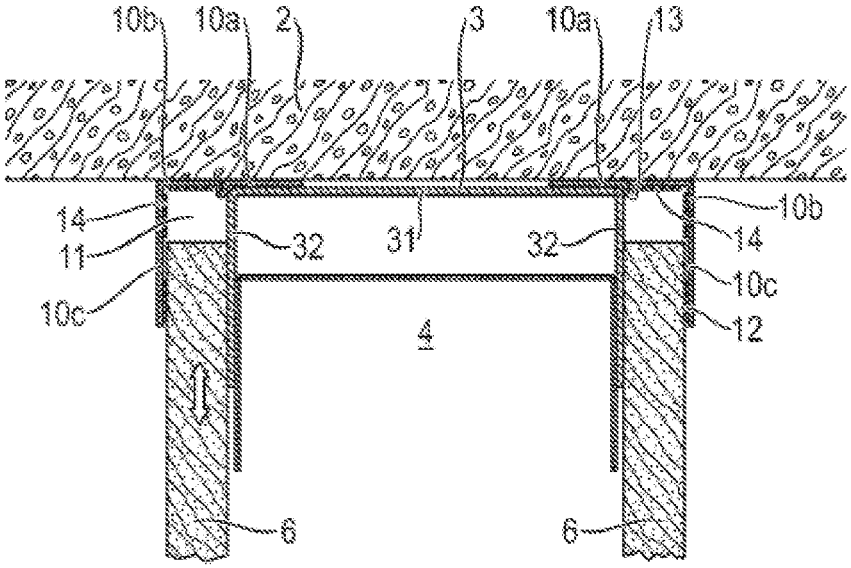
FIG. 2 shows a cross-sectional diagram through a rim region of a drywall with a sealing device according to a further embodiment.

A further embodiment is illustrated in FIG. 2, wherein a cavity 11 is likewise formed by a sealing portion 10*b*. In contrast to the embodiment of FIG. 1, sealing portion 10*b* has only one kinking point 10*d*, so that the segments respectively represent the extensions of retaining portion 10*a* and of positioning portion 10*c*.

In order to absorb the movement of drywall panel 6 relative to connecting building element 2, drywall panel 6 slides along sealing device (10), especially along sealing element 12.

For the region of the transition between retaining portion 10*a* to sealing portion 10*b*, a stop element 13, protruding in the direction of sealing portion 10*b* and having the form of a bead or the like, for example, may be formed in order to achieve optimum positioning of sealing device 10 prior to mounting of drywall panel 6. Thereby it is ensured that sealing device 10 extends substantially parallel to the extent direction of connecting profile 3 or of drywall 1.

Alternatively, it is also possible for sealing device 10 to be so configured by kinking of sealing portion 10*b* inward at kinking point 10*d* that it may be easily mounted by placing the end of sealing portion 10*b* flush against profile piece 3, meaning that kinking point 10*d* functions as a positioning and mounting aid.

For the region of the transition between retaining portion 10*a* to sealing portion 10*b*, a stop element 13, protruding in the direction of sealing portion 10*b* and having the form of a bead or the like, for example, may be formed in order to achieve, for insertion of retaining portion 10*a* of sealing device 10 between connecting profile 3 and connecting building element 2, simplified positioning during mounting of drywall 1. Thereby it is ensured that sealing device 10 extends substantially parallel to the extent direction of connecting profile 3 or of drywall 1.

Both in the embodiment of FIG. 1 and also that of FIG. 2, sealing device 10 may be equipped in the region of sealing portion 10*b* with an intumescent material 14, so that, in the fire situation, cavity 11 becomes filled by the intumescent material being formed and thereby additional sealing and insulation is achieved, or it may contain an ablatively acting fire-protection additive, in which case both individual compounds and a mixture of several compounds may be used as additives. The intumescent material may be an intumescent foam, an intumescent coating or an intumescent strip. Intumescent material is generally understood as a material that swells and forms an insulating layer of flame-retardant material under the effect of heat, for example in the fire situation.

The invention claimed is:

1. An apparatus, comprising:

a profile piece with a U-shaped cross section comprising a base portion with oppositely disposed edges and extending in an extent direction and two limb portions coupled to respective ones of the oppositely disposed edges in a direction transverse to the extent direction; and;

a sealing device comprising:

a retaining portion between the base portion and a connecting building element in an installed state, a sealing portion extending in direction transverse to the extent direction and comprising a plurality of kinking points, and a positioning portion coupled to the sealing portion, wherein the retaining portion and the sealing portion are disposed to form a cavity provided by an upper edge of a drywall panel in the installed state, one of the two limb portions, and the retaining portion and the sealing portion, and wherein the kinking points form a plurality of angled segments that move in order to absorb relative movement of the drywall panel and the connecting building element.

2. The apparatus according to claim 1, wherein the sealing device is coated or equipped in a region of the sealing portion with an intumescent material, so that the cavity becomes completely or partly filled by the intumescent material under the effect of heat, or the sealing portion comprises an ablatively acting fire-protection additive.

3. The apparatus according to claim 1, wherein the plurality of angled segments of the sealing portion are tilted toward one another, at least one of which is oriented at an inclination or transverse to the extent direction of one or both of the two limb portions of the profile piece.

4. The apparatus according to claim 3, wherein the sealing device is equipped in a region of the sealing portion with three kinking points, so that two of the plurality of angled segments of the sealing portion are tilted toward one another to form a V-like shape.

5. The apparatus according to claim 4, wherein the V-like shape of the segments of the sealing portion point in the direction of the limb portions or in a direction opposite thereto.

6. The apparatus according to claim 1, further comprising a sealing element between in a gap between the positioning portion and a side of the drywall panel.

7. The apparatus according to claim 1, further comprising a projecting stop element between the retaining portion and the sealing portion.

8. The apparatus according to claim 3, wherein at least one of the kinking points serve as a positioning and mounting aid for the drywall panel between the retaining portion and the sealing portion.

9. The apparatus according to claim 1, wherein the connecting building element is selected from the group consisting of a room ceiling, a floor, and a solid wall.

10. The apparatus according to claim 1 further comprising a projecting stop element is provided between the retaining portion and the sealing portion, and wherein the projecting stop element is a bead protruding in the direction of the cavity.

11. A method of sealing a drywall panel using the apparatus according to claim 1, the method comprising:

attaching the sealing device to the drywall panel, wherein, upon said attaching, the sealing device is disposed such that the cavity is formed between an edge of the drywall panel, the connecting building element, one of the limb portions, and the sealing portion.

* * * * *